US008348535B2

(12) United States Patent
Kageyama

(10) Patent No.: US 8,348,535 B2
(45) **Date of Patent: *Jan. 8, 2013**

(54) STICK-SHAPED MATERIAL PROPELLING CONTAINER

(75) Inventor: Hidehei Kageyama, Saitama (JP)

(73) Assignee: Kotobuki & Co., Ltd., Kawagoe, Saitama (JP)

( * ) Notice: Subject to any disclaimer, the term of this patent is extended or adjusted under 35 U.S.C. 154(b) by 951 days.

This patent is subject to a terminal disclaimer.

(21) Appl. No.: 12/055,866

(22) Filed: Mar. 26, 2008

(65) Prior Publication Data

US 2008/0247804 A1 Oct. 9, 2008

(30) Foreign Application Priority Data

Apr. 3, 2007 (JP) ..... 2007-97570

(51) Int. Cl.
*B43K 21/22* (2006.01)

(52) U.S. Cl. ..... 401/93; 401/88; 401/94

(58) Field of Classification Search ..... 401/55, 401/92, 93, 94, 88

See application file for complete search history.

(56) References Cited

U.S. PATENT DOCUMENTS

| | | | | |
|---|---|---|---|---|
| 2,181,202 | A * | 11/1939 | Prain | 401/93 |
| 2,594,955 | A * | 4/1952 | Markowitz | 248/683 |
| 2,652,029 | A * | 9/1953 | Metealf | 15/433 |
| 4,856,693 | A | 8/1989 | Kageyama et al. | |
| 5,362,166 | A * | 11/1994 | Yamamoto et al. | 401/93 |
| 7,878,726 | B2 * | 2/2011 | Kageyama et al. | 401/92 |
| 2004/0161284 | A1 * | 8/2004 | Ohba et al. | 401/92 |

FOREIGN PATENT DOCUMENTS

| | | |
|---|---|---|
| EP | 0 280 220 | 8/1988 |
| EP | 1 808 308 | 7/2007 |
| JP | 56 108575 | 8/1981 |
| JP | 62-26097 | 2/1987 |
| JP | 62-108497 | 7/1987 |
| JP | 2001 277778 | 10/2001 |
| JP | 2006-056152 | 2/2006 |
| JP | 206 335040 | 12/2006 |
| JP | 2006-335040 | 12/2006 |

OTHER PUBLICATIONS

European Search Report; European Patent Office; Jul. 3, 2008 ;EPO Form 1503 03.82 (P04c01).

Japanese Office Action for related Japanese Patent Application No. 2007-097570, office action issued on Apr. 3, 2012.

* cited by examiner

*Primary Examiner* — Dinh Q Nguyen
*Assistant Examiner* — Viet Le
(74) *Attorney, Agent, or Firm* — Miller, Matthias & Hull LLP

(57) ABSTRACT

In a stick-shaped material propelling container capable of propelling and retracting a stick-shaped material, the influence of variation of the dimension of the stick-shaped material can be made small. An inner barrel is slidably inserted in an outer barrel, an elastic body which urges the inner barrel rearward is provided between the inner barrel and the outer barrel, a chuck piece which holds a stick-shaped material is provided at a tip end portion of the inner barrel, and a chuck ring is inserted between the chuck piece and the outer barrel. A cross section of the stick-shaped material forms a triangular shape, the frictional force applying part which is in contact with the stick-shaped material to apply a frictional force is formed on an inner peripheral surface of the outer barrel, and the frictional force applying part abuts on a side in the vicinity of a vertex of the stick-shaped material in a cross section of the stick-shaped material.

8 Claims, 10 Drawing Sheets

STICK-SHAPED MATERIAL PROPELLING CONTAINER

BACKGROUND OF THE INVENTION

1. Field of the Invention

The present invention relates to a stick-shaped material propelling container capable of propelling and retracting a stick-shaped material such as a stick-shaped eraser, a pencil lead, a crayon, a pastel and an eye brow stick.

2. Description of the Related Art

Heretofore, a stick-shaped material propelling container of this kind, are known from Japanese Utility Model Publication No. 3-44552 or Japanese Utility Model Publication No. 5-1426. In the stick-shaped propelling container disclosed in each of the documents, an inner barrel is slidably inserted in an outer barrel, and an elastic body which urges the inner barrel rearward is provided between the inner barrel and the outer barrel. Chuck pieces which hold the stick-shaped material are provided at a front end portion of the inner barrel, and a chuck ring is inserted between the chuck pieces and the outer barrel. The stick-shaped material can be propelled and retracted in response to the longitudinal sliding movement of the inner barrel relative to the outer barrel.

The conventional stick-shaped material propelling container is based on the premise that the cross-sectional shape of the stick-shaped material is circular, and when the tip end of the stick-shaped material, for example, a stick-shaped eraser is consumed and rounded, a delicate operation such as erasing of fine portions becomes difficult.

Thus, Japanese Patent Laid-Open No. 2006-335040 proposes a stick-shaped material propelling container suitable for causing the stick-shaped material to perform a delicate operation and capable of reliably holding the stick-shaped material.

In order to achieve a correct propelling operation of the stick-shaped material propelling container, a frictional force in a proper range has to be generated between the stick-shaped material and frictional force applying parts of the container for contacting with the stick-shaped material. The friction force is an important factor to stop return of the stick-shaped material. In the constitution disclosed in Japanese Patent Laid-Open No. 2006-335040 ribs as the friction force applying parts are formed on the inner peripheral surface of the outer barrel. The respective ribs contact with three vertexes of the stick-shaped material in the cross section.

When the ribs are brought into contact with the vertexes of the stick-shaped material in the cross-section, the dimension of a circumscribed circle connecting the vertexes in the cross section is important However, the dimension of the stick-shaped material is variable depending on conditions at the production and it is difficult to produce the stick-shaped material whose dimension of the circumscribed circle is very accurate. As a result, a problem is that the frictional force significantly changes due to the dimensional variation of the stick-shaped material up to exceed the proper range, whereby leading an operation failure that the stick-shaped material cannot be properly propelled.

SUMMARY OF THE INVENTION

The present invention is made in view of the above problems, and has an object to provide a stick-shaped material propelling container capable of generating a frictional force in a proper range between a frictional force applying part and a stick-shaped material, and smoothly performing a propelling operation of the stick-shaped material.

In order to attain the above-described object, the present invention is, a stick-shaped material propelling container according to the present invention comprises an outer barrel, an inner barrel which is slidably inserted in the outer barrel, an elastic body provided between the inner barrel and the outer barrel to urge the inner barrel rearward, a plurality of chuck pieces provided at a front end portion of the inner barrel to hold a stick-shaped material, and a chuck ring inserted between the chuck pieces and the outer barrel. The stick-shaped material can be propelled and retracted in response to a sliding movement of the inner barrel in a longitudinal direction relative to the outer barrel.

A cross section of the aforesaid stick-shaped material is formed into a shape of a polygon (including a triangle and a rectangle, and the same shall apply hereinafter). Frictional force applying parts are formed on an inner peripheral surface of the outer barrel to contact with the stick-shaped material and apply a frictional force. The frictional force applying parts abut on a side except for a vertex of the stick-shaped material in the cross section of the stick-shaped material.

Since the frictional force applying part formed on the outer barrel abuts on the side except for the vertex, of the stick-shaped material in the cross section of the stick-shaped material, the influence of variation in dimension of the stick-shaped material is smaller in the side than in the vertex in the cross section of the stick-shaped material. Therefore, the frictional force in a proper range can be generated between the frictional force applying part and the stick-shaped material, and the propelling operation of the stick-shaped material can be smoothly performed.

The frictional force applying parts can be provided in correspondence with each vertex of the stick-shaped material, and comprise a pair of projections which are adapted to abut on adjacent sides symmetrically with respect to a center line of the stick-shaped material cross section, which passes through the vertex between the adjacent sides. The frictional force can be applied to the stick-shaped material with good balance because the frictional force applying part is constituted of a pair of projections which abut on the adjacent sides symmetrically with respect to the vertex.

Alternatively, the frictional force applying parts can be provided in correspondence with each vertex of the stick-shaped material, and at least one of the frictional force applying part comprises a pair of projections which are adapted to abut on adjacent sides symmetrically with respect to a center line of the stick-shaped material cross section, which passes through the vertex between the adjacent sides, and the other frictional force applying part(s) comprises a projection which is adapted to abut on only either one of adjacent sides to the vertex. In some cases, the frictional force might become too large if the same friction was applied to the sticks shaped material in the vicinities of all the vertexes. The frictional force can be adjusted by adopting the projection structures differing in the vicinity of some vertex and in the vicinities of the remaining vertexes.

The frictional force applying parts can have flexibility, and in its cross section, an extending direction of the frictional force applying part at a contact point where the frictional force applying part contacts the stick-shaped material can be in a non-orthogonal relation with respect to a tangential line of the stick-shaped material at the contact point.

The frictional force applying part can bend in the direction orthogonal to its extending direction depending on the variation in the stick-shaped material, and thereby, it can absorb the variation. By adjusting bendability of the frictional force applying part, the susceptibility on the frictional force by the variation in the dimension of the stick-shaped material can be reduced.

The frictional force applying part can be in a shape creating an asymptote toward the contact point of the stick-shaped material in its cross-section. By forming the frictional force applying part in the shape which creates the asymptote toward the contact point of the stick-shaped material, the frictional force applying part is formed into a shape which makes it more bendable, and the susceptibility on the frictional force by the variation of the dimension of the stick-shaped material can be reduced.

The present disclosure relates to subject manner contained in Japanese Patent Application No. 2007-97570, filed on Apr. 3, 2007, which is expressly incorporated herein by reference in its entirety.

BRIEF DESCRIPTION OF THE DRAWINGS

FIG. 9A shows the case according to the present invention, and FIG. 9B shows the conventional case;

DETAILED DESCRIPTION OF THE PREFERRED EMBODIMENTS

Figure 1:
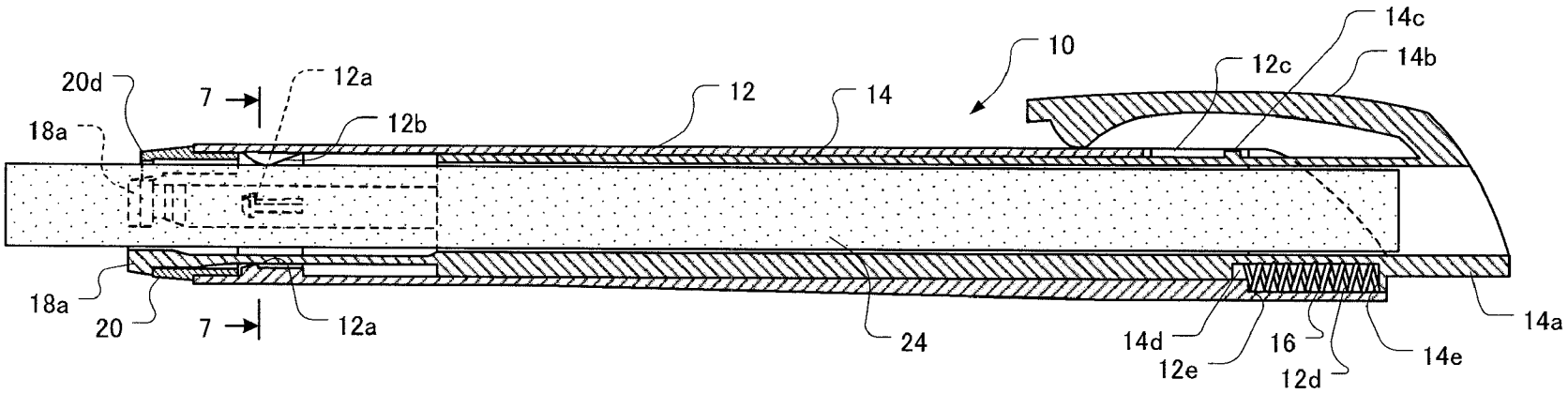
FIG. 1 is a general longitudinal sectional view showing an embodiment of a stick-shaped material propelling container of the present invention.

Hereinafter, an embodiment of the present invention will be described by referring to the drawings.

Figure 2:
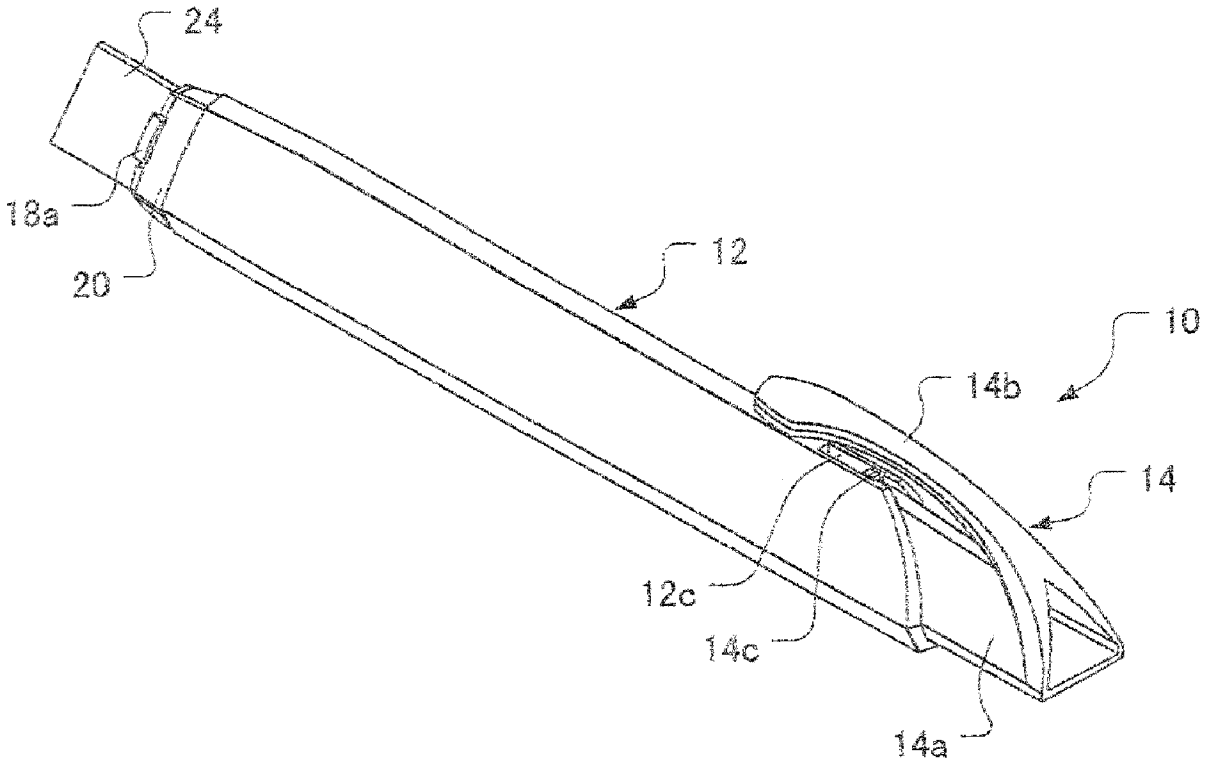
FIG. 2 is a general perspective view of the stick-shaped material propelling container of FIG. 1.

FIG. 1 is a general longitudinal sectional view showing an embodiment of a stick-shaped material propelling container according to the present invention, and FIG. 2 is a general perspective view.

In the drawings, a stick-shaped propelling container 10 includes an outer barrel 12, an inner barrel 14 which is slidably inserted in the outer barrel 12, and a coil spring 16 which is an elastic body provided between the inner barrel 14 and the outer barrel 12 to bias the inner barrel 14 rearward. The cross-sectional shapes of the respective outer peripheral surface and the inner peripheral surface of the outer barrel 12 and the inner barrel 14 are each in a triangular shape in accordance with the cross-sectional shape of a stick-shaped material 24 which will be described later, and each includes three sides constituting main sides. However, the cross-sectional shape does not always have to be a mathematically accurate triangle, each side may be a curved line with a small curvature instead of a straight line, and the vertexes may be rounded instead of being angular.

Figure 3:
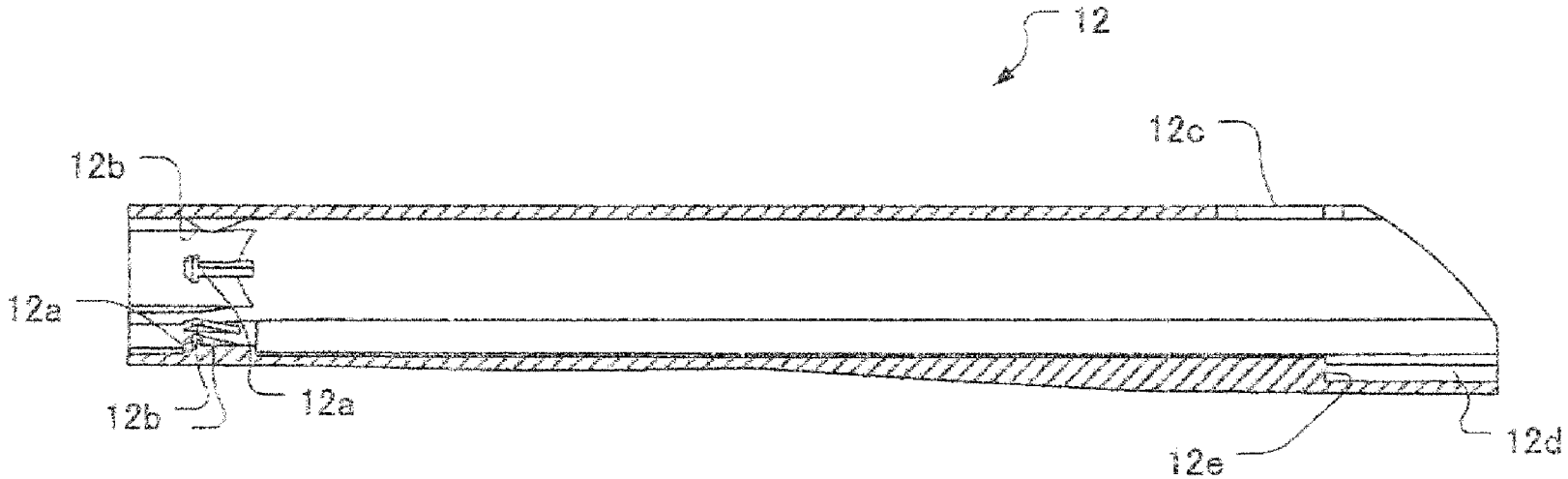
FIG. 3 is a longitudinal sectional view of an outer barrel.
Figure 7:
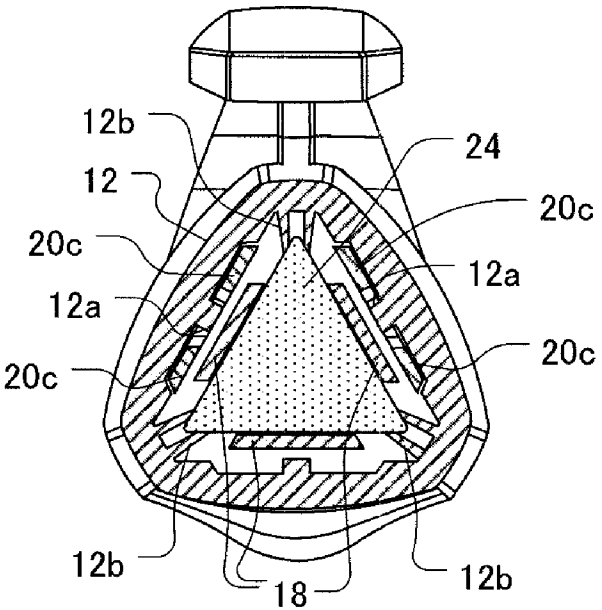
FIG. 7 is a sectional view taken along line 7-7 of FIG. 1.

On the inner peripheral surface of the front end portion of the outer barrel 12, as shown in FIGS. 3 and 7, slip-off preventing ribs 12*a* are formed at the portions corresponding to the sides of the triangle in the cross-sectional shape, and frictional force applying parts 12*b* are formed at the portions corresponding to the vicinities of the vertexes of the triangle in the cross-sectional shape. The respective ribs 12*a* and frictional force applying parts 12*b* are projected toward the central axis. Each of the frictional force applying parts 12*b* is configured of a pair of projections formed in the vicinity of each of the vertexes of the triangle of the cross-sectional shape and formed symmetrically with respect to the center-line of the triangle passing through each of the vertexes. The tip ends of a pair of projections 12*b* and 12*b* extend in the direction to be close to each other. Due to flexibility of each of the projections, the spacing between the tip ends of the paired projections 12*b* and 12*b* is variable.

As shown in FIG. 3, a slit 12*c* extending from a rear end portion is formed at an upper portion of the rear end portion of the outer barrel 12, and an inlet port at the rear portion of the slit 12*c* is a narrow portion. Further, a lower portion of the rear end portion of the outer barrel 12 is thick as compared with the other portions, and a groove of a substantially semicircular sectional shape is formed in the thick portion. The groove constitutes an elastic body housing part 12*d* for the coil spring 16. Further, a groove wall surface at a front end portion of the elastic body housing part 12*d* constitutes an elastic body receiving part 12*e*.

Figure 4:
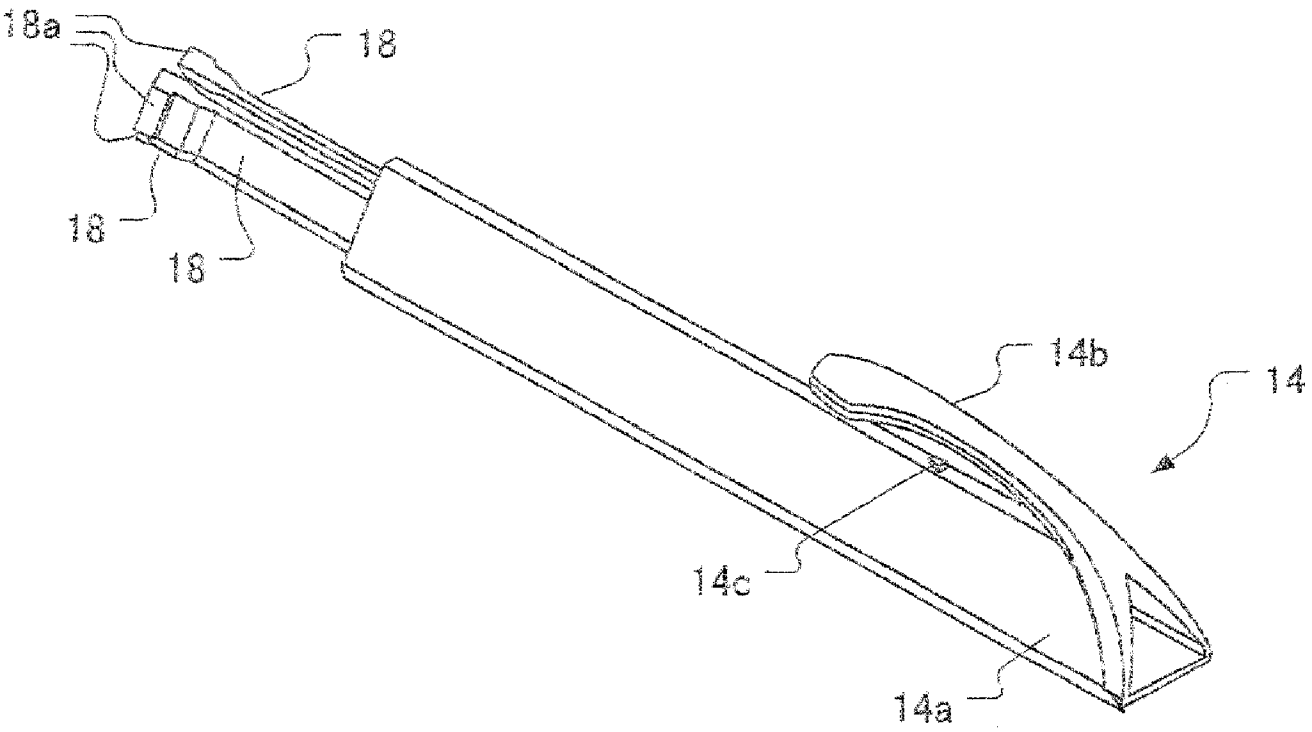
FIG. 4 is a perspective view of an inner barrel seen from the rear side.
Figure 5A:
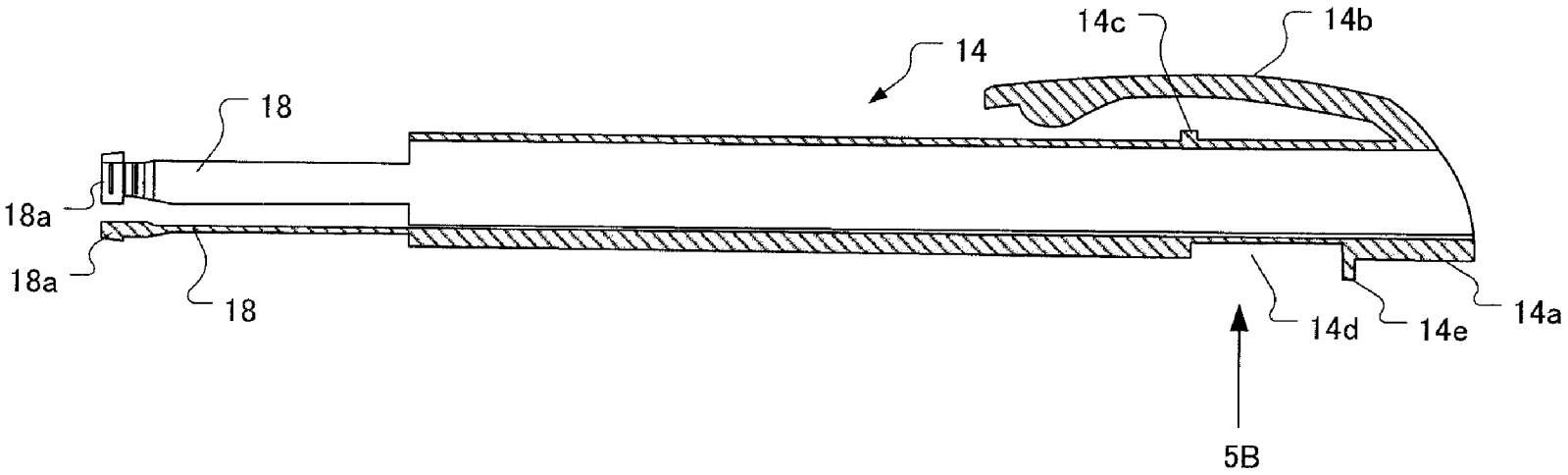
FIG. 5A is a longitudinal sectional view of the inner barrel.
Figure 5B:
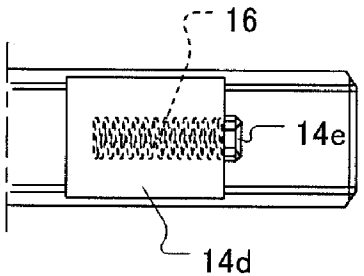
FIG. 5B is a view on arrow along line 5B.

As shown in FIGS. 1, 4 and 5, a projection 14*c* is formed at a peripheral surface of an upper portion of a rear portion of the inner barrel 14. The projection 14*c* is pushed in from the narrow portion of the above described slit 12*c* of the outer barrel 12, and is slidably fitted in the slit 12*c*. The rear end portion of the inner barrel 14 is projected from the rear end of the outer barrel 12. The projected portion of the inner barrel 14 constitutes a knock part 14*a*. A clip 14*b* is integrally formed on the knock part 14*a*. The clip 14*b* extends along the outer barrel 12 above the slit 12*c* on the outer side of the outer barrel 12.

A lower portion of the rear portion of the inner barrel 14 is thin as compared with the other portions, and the portion constitutes an elastic body housing part 14*d* for the coil spring 16. An elastic body receiving part 14*e* which is projected in the outward direction is formed at the rear end portion of the elastic body housing part 14*d*.

The elastic body housing part 12*d* of the above described outer barrel 12 and the elastic body housing part 14*d* of the inner barrel 14 are opposed to each other with their positions in the circumferential direction aligned with each other, and the coil spring 16 is placed in a space defined by the elastic body housing part 12*d* and the elastic body housing part 14*d*. Thus, the coil spring 16 is interposed between the elastic body receiving part 12*e* and the elastic body receiving part 14*e*, and always urges the inner barrel 14 rearward with respect to the outer barrel 12.

Three chuck pieces 18, 18 and 18 are provided at the front end portion of the inner barrel 14, and a head part 18*a* of each of the chuck pieces 18 is projected from the front end of the outer barrel 12. Each chuck piece 18 is disposed to correspond to a central portion of each side of the cross-sectional triangle of the stick-shaped material 24 (see FIG. 7). Further, the plurality of chuck pieces 18 are prestressed to extend in the directions to be away from the axial center portion and from each other.

A chuck ring 20 is inserted between the chuck piece 18 and the outer barrel 12. The chuck ring 20 includes a main body 20*a*. In the main body 20*a* of the chuck ring 20, the respective cross-sectional shapes of its outer peripheral surface and inner peripheral surface of the main body 20*a* of the chuck ring 20 are triangular, in correspondence with the cross-sectional shape of the stick-shaped material 24, and each include three sides constituting main sides. Also, in this case, the cross-sectional shapes do not always have to be mathematically accurate triangles, and each side may be a curved line with a small curvature instead of a straight line.

Figure 6B:
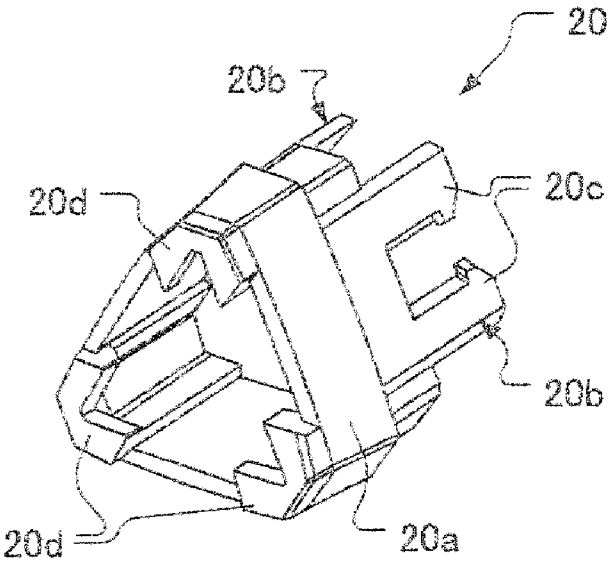
FIG. 6B is a perspective view of the chuck ring seen from the front side.
Figure 6A:
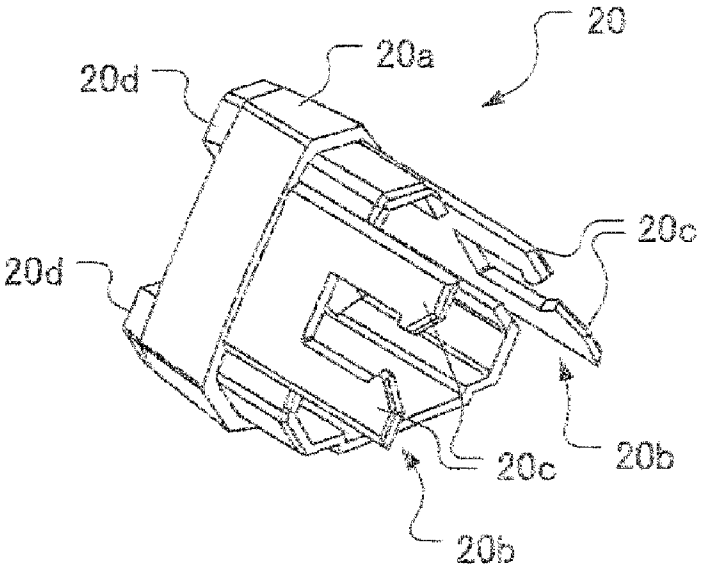
FIG. 6A is a perspective view of a chuck ring seen from the rear side.

A part of the main body 20*a* is disposed outside and forward of the outer barrel 12, and two engaging parts 20*b* and 20*b* for making the chuck ring 20 slidable with respect to the outer barrel 12 and preventing the chuck ring 20 from slipping off from the outer barrel 12 extend into the outer barrel 12 from the rear end portion of the main body 20*a*. Each of the engaging parts 20*b* includes a pair of hook pieces 20*c* and 20*c* which have the hooked head portions opposed to each other as shown in FIGS. 6A and 6B.

The hook pieces 20*c* and 20*c* of the engaging part 20*b* are slidably guided by the above described slip-off preventing rib 12*a* of the outer barrel 12, and when the hook pieces 20*c* and 20*c* are caught by an enlarged head portion of the slip-off preventing rib 12*a*, a further advance of the chuck ring 20 is inhibited to prevent the outer barrel 12 from slipping off in the forward direction.

Further, projected corner parts 20*d*, 20*d* and 20*d* which are projected forward and to the direction toward the axis are formed at the front end portion of the main body 20*a* of the chuck ring 20. In a normal state, the head part 18*a* of the chuck piece 18 is fitted in a space between the adjacent projected corner parts 20*d*. The head part 18*a* of the chuck piece 18 which is urged rearward by the spring 16 is prevented from displacing rearward by the main body 20*a*, and is prevented from extending in the direction to be away from the axial center portion by the projected corner part 20*d*.

The stick-shaped material 24, which is a stick eraser of a triangular prism shape, i.e. having the cross section of the triangular shape, is housed in the outer barrel 12 and the inner barrel 14. Therefore, a plurality of ridge lines and a plurality of inclined planes are formed on the peripheral surface of the stick-shaped material 24. As shown in FIG. 7, the frictional force applying parts 12*b* of the outer barrel 12 are in contact with the portions corresponding to the sides (inclined planes) in the vicinity of the vertexes (ridge lines) of the triangle in the cross section of the stick-shaped material 24. In more detail, at each vertex, the frictional force applying part 12*b* constituted of a pair of projections abuts on the sides (inclines planes) in the vicinity of each vertex of the stick-shaped material 24 with positioning the vertex (ridge line) at an intermediate position between the projections.

In the stick-shaped propelling container 10 constituted as above, the head parts 18*a* of the chuck pieces 18 are inhibited from extending away from the axial center by the chuck ring 20 in a normal state. Therefore, each of the chuck pieces 18 abuts on the central portion of the side of the cross-sectional triangle of the stick-shaped material 24 to press the stick-shaped material 24, and thereby, the stick-shaped material 24 is inhibited from moving. Accordingly, the front portion of the stick-shaped material 24, which is forward of the portion fastened by the chuck pieces 18, can be used with gripping the outer barrel 12.

As the tip end of the stick-shaped material 24 is consumed with use, it becomes rounded. However, on the peripheral surface of the stick-shaped material 24, the ridge lines corresponding to the vertexes of the triangle exist, and therefore, an erasure operation for fine portions can be performed by using the ridge lines.

When the stick-shaped material 24 is desired to be further propelled, the knock part 14*a* is knocked. Thereby, the chuck pieces 18 and the stick-shaped material 24 advance, and the chuck ring 20 also advances together by the friction from the chuck pieces 18. However, the chuck ring 20 can only move until the hook pieces 20*c* abut on the head portions of the slip-off ribs 12*a*, and when they abut on the head portions, they cannot advance any more. Therefore, only the chuck pieces 18 advance. At this time, the chuck pieces 18 pass between the projected corner parts 20*d* of the chuck ring 20. Because the dimension of each gap between the adjacent chuck pieces 18 becomes smaller at the rear side, the chuck pieces 18 are forced to extend in the direction away from the axial center portion from each other by the projected corner parts 20*d*. Thereby, the stick-shaped material 24 is released from fastening of the chuck pieces 18. When knock on the knock part 14*a* is released, the chuck pieces 18 are retracted by the biasing force of the spring 16 to return to the initial position. At this time, until the chuck pieces 18 exhibit the fastening force by the chuck ring 20, the stick-shaped material 24 is held at the position at which it advances by the frictional force by the frictional force applying parts 12*b* of the outer barrel 12. A sequence of the operations causes the stick-shaped material 24 to be propelled by a length substantially corresponding to the length by which the engaging parts 20*b* of the chuck ring 20 slide with respect to the outer barrel 12.

When the propelled stick-shaped material 24 is desired to be retracted, it can be done by knocking the knock part 14*a* to bring the stick-shaped material 24 into a state in which the stick-shaped material 24 is released from fastening of the chuck pieces 18, and pushing the stick-shaped material 24 rearward.

If the frictional force between the frictional force applying parts 12*b* and the stick-shaped material 24 was not properly generated in the above propelling operation, the stick-shaped material 24 could not be held and could not be propelled, or the stick-shaped material 24 could not be pushed in smoothly. Because the dimension of the stick-shaped material 24 is variable, it is important to make the frictional force less susceptible to the influence of the variation of the dimension of the stick-shaped material.

Figure 8:
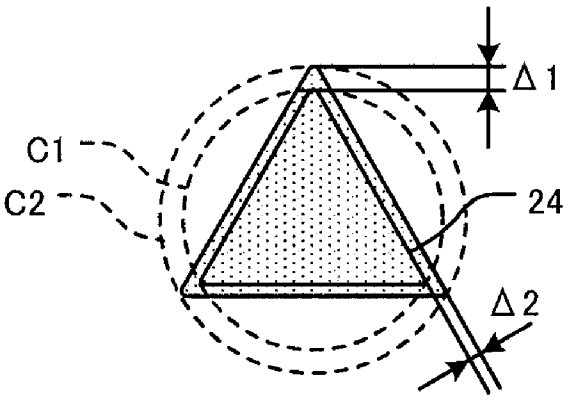
FIG. 8 is an explanatory sectional view showing the influence by a variation in the dimension of the stick-shaped material.

Firstly, in this embodiment, the influence of the variation is reduced by the frictional force applying part 12*b* contacting the sides (inclined planes) of the stick-shaped material 24. As shown in FIG. 8, assuming that variation happens to the dimension of the stick-shaped material 24, a case where the circumscribed circle C1 of the stick-shaped material 24 becomes C2 is considered. In this case, the relationship of a dimensional change $\Delta 1$ at the vertex (ridge line) and a dimensional change $\Delta 2$ in the side (inclined plane) becomes $\Delta 1 = 2 \times \Delta 2$ if the stick-shaped material 24 is an equilateral triangle, and the influence of the dimensional change in the inclined plane is smaller than at the vertex. Therefore, the change in the frictional force is smaller as the frictional force applying part 12*b* is brought into contact with the inclined plane of the stick-shaped material 24.

Secondly, in this embodiment, the extending direction of each frictional force applying part 12*b* at the contact point where the frictional force applying part 12*b* contacts the stick-shaped material 24 is in the non-orthogonal relation with the tangential line of the stick-shaped material 24 at the contact point in the cross section. The frictional force applying part 12*b* can absorb the variation in the dimension of the stick-shaped material 24 by bending as shown by the phantom line of FIG. 9A. By properly setting the sectional secondary moment, the projected length and the elastic coefficient of the frictional force applying part 12*b*, the change of the frictional force by the bending is adjusted so that the frictional force can be prevented from changing significantly.

Figure 9B:
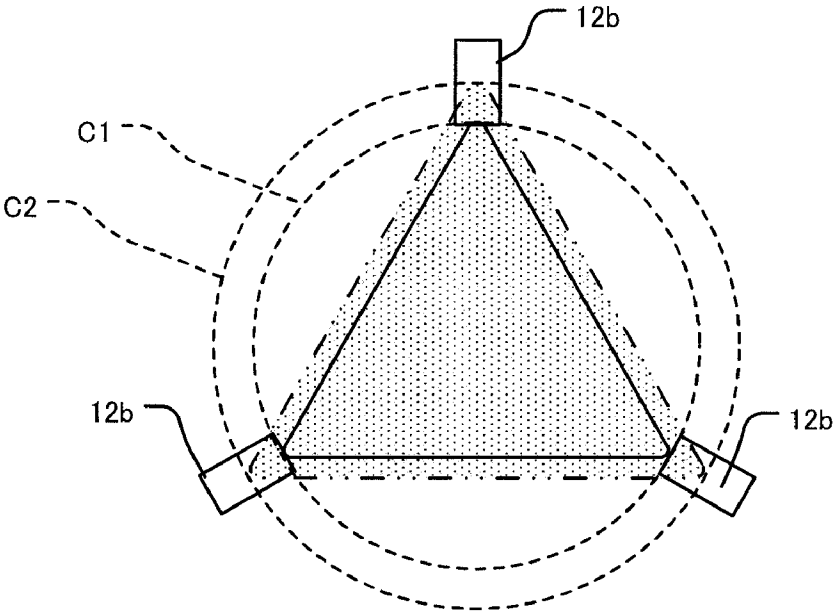
FIGS. 9A and 9B are explanatory sectional views showing the influence by the variation of the stick-shaped material.
Figure 9A:
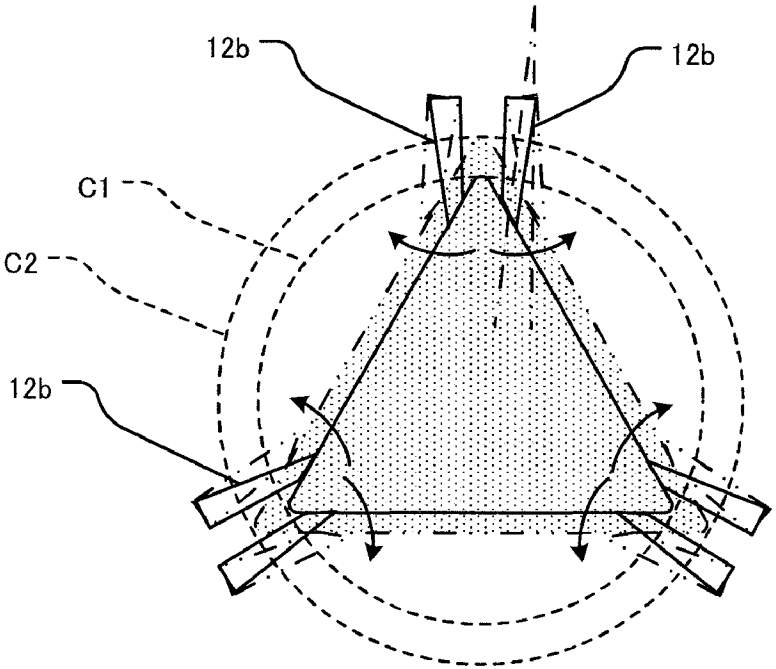

On the other hand, if the frictional force applying part 12*b* contacts the vertex (ridge line) of the stick-shaped material 24 as shown in FIG. 9B, the projected direction, that is, the extending direction of the frictional force applying part 12*b* is orthogonal to the tangential line of the stick-shaped material 24 at the contact point where the frictional force applying part 12*b* contacts the stick-shaped material 24. Therefore, bending of the frictional force applying parts 12*b* cannot be expected, or compression of the frictional force applying parts 12*b* cannot be expected. Therefore, when the circumscribed circle of the stick-shaped material 24 changes from C1 to C2, there is no other measure but to expect with the change of the stick-shaped material 24 by compression, and as a result, the frictional force increases.

Further, in this embodiment, a pair of projections for each vertex, which constitute the frictional force applying part 12*b* contact the adjacent either sides of the stick-shaped material 24 symmetrically with respect to each vertexes of the stick-shaped material 24, and therefore, the stick-shaped material 24 can be held with good balance.

As described above, according to this embodiment, even if variation happens to the dimension of the stick-shaped material 24, the change in the frictional force can be reduced, and can be kept within the range of a proper frictional force. Therefore, the stick-shaped material 24 can be smoothly propelled.

Figure 11:
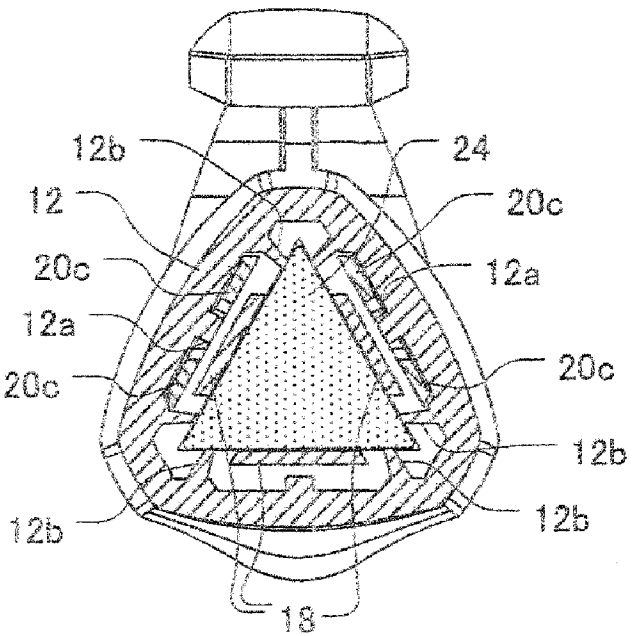
FIG. 11 is a view showing another example of the frictional force applying part.
Figure 10:
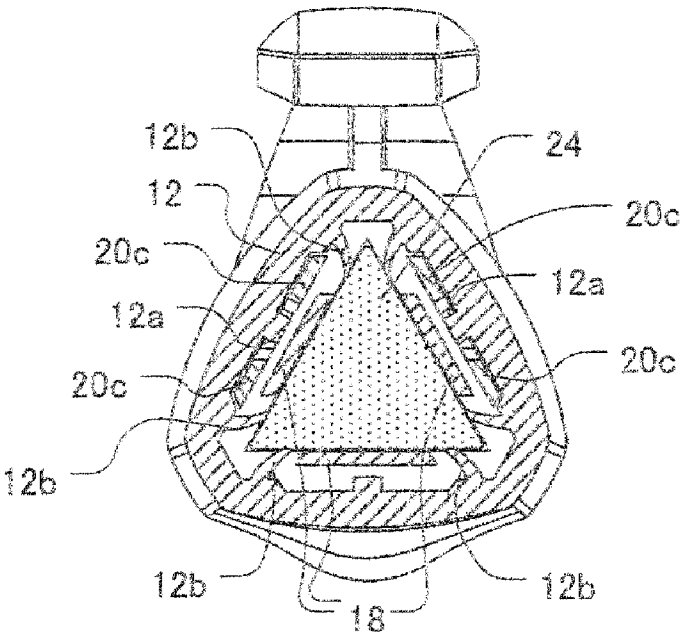
FIG. 10 is a view showing another example of a frictional force applying part.

FIGS. 10 and 11 show modified examples of the frictional force applying part 12*b*. The frictional force can be prevented from changing significantly by changing the shape of the frictional force applying part 12*h* and making it mote bendable. For example, as shown in FIG. 10, in the cross section of the frictional force applying part 12*b*, the shape is formed so as to create the asymptote toward the contact point of the stick-shaped material 24. Thereby, the frictional force applying part 12*b* is in a more bendable shape.

Figure 12:
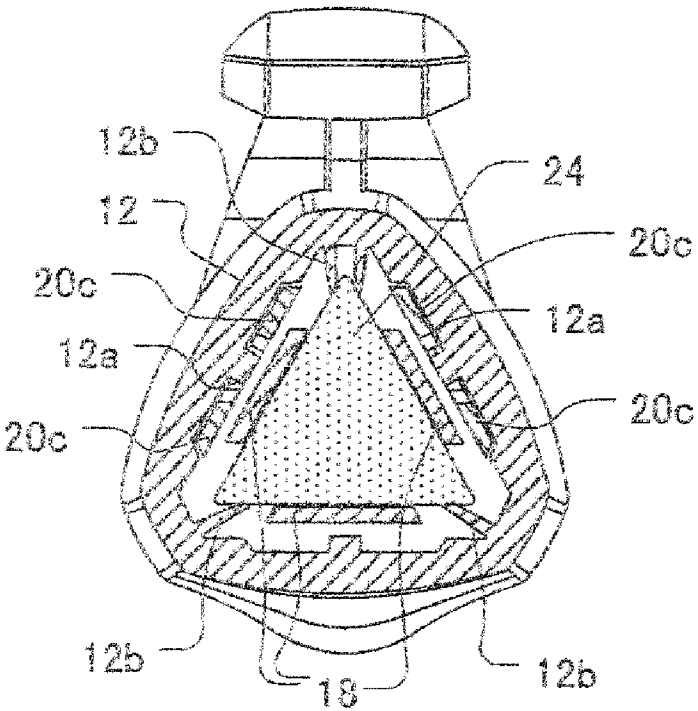
FIG. 12 is a view showing another example of the frictional force applying part.

FIG. 12 shows still another modified example of the frictional force applying part 12*b*. In some cases, the frictional force might become too large if all the projections 12*b* in the vicinities of all the vertexes of the stick-shaped material 24 were of the same structures as in the previous examples. In such cases, the constitution shown in FIG. 12 may be preferable. In this example, for some (one in the drawing) of vertexes, a pair of projections are in contact with the sides of the stick-shaped material 24 symmetrically with respect to the vertex of the stick-shaped material 24, and for each of the other vertexes, only one projection abuts on either one of the adjacent sides to the vertex. In this manner, adjustment of the frictional force can be performed by reducing the number of projections 12*b* in contact with the stick-shaped material 24. In this case, the entire constitution of the frictional force applying parts 12*b* can be constituted to be mirror symmetrical with respect to the center line passing through the center of gravity of the stick-shaped material 24, and therefore, the stick-shaped material 24 can be held with good balance.

In the above description, the case in which the cross sectional shape of the stick-shaped material is an equilateral triangle is described, but the cross sectional shape of the stick-shaped material is not limited to an equilateral triangle and can be any triangular shape or any polygonal shape which is a rectangle or a shape having more sides. At least one member of the outer barrel, inner barrel and chuck ring can be formed into a shape corresponding to the polygonal shape of the stick-shaped material. By increasing the number of the ridge lines of the stick-shaped material 24, the number of the corner parts increases, and the stick-shaped material 24 can be made suitable for more delicate operations.

While the principles of the invention have been described above in connection with specific embodiments, and particular modifications thereof, it is to be clearly understood that this description is made only by way of example and not as a limitation on the scope of invention.

What is claimed is:

1. A stick-shaped material propelling container for propelling and retracting a stick-shaped material whose cross section is of a polygon comprising:

an outer barrel;

an inner barrel slidably inserted in the outer barrel;

an elastic body provided between the inner barrel and the outer barrel to urge the inner barrel rearward in accordance with a slide movement of the inner barrel;

a plurality of chuck pieces provided at a front end portion of the inner barrel to fasten and release a stick-shaped material, said chuck pieces capable of advancing and retracting;

a chuck ring inserted between the chuck pieces and the outer barrel; and frictional force applying parts formed on an inner peripheral surface of said outer barrel to impart a frictional force to a stick-shaped material so as to hold it in position while the chuck pieces are retracting, each frictional force applying part being assigned to a vertex of the polygon of a stick-shaped material and comprising a pair of flexible projections which project radially inward from the inner peripheral surface of said outer barrel and are adapted to abut on adjacent sides to the assigned vertex of the polygon symmetrically with respect to a center line of the polygon, which passes through the assigned vertex between the adjacent sides of the polygon.

2. The stick-shaped material propelling container according to claim 1, wherein the chuck pieces are adapted to abut on a central portion of an assigned side of the polygon of a stick-shaped material, and said flexible projections are adapted to abut on a vertex side of the polygon from the central portion where the chuck pieces are adapted to abut on.

3. The stick-shaped material propelling container according to claim 1, wherein an extending direction of each flexible projection at a contact point where each flexible projection contacts a stick-shaped material is in a non-orthogonal relation in its cross section with respect to a tangential line of a stick-shaped material at the contact point.

4. The stick-shaped material propelling container according to claim 3, wherein at least one of said flexible projections is in a shape creating an asymptote toward the contact point of a stick-shaped material in its cross-section.

5. A stick-shaped material propelling container for propelling and retracting a stick-shaped material whose cross section is of polygon comprising:

an outer barrel;

an inner barrel slidably inserted in the outer barrel;

an elastic body provided between the inner barrel and the outer barrel to urge the inner barrel rearward in accordance with a slide movement of the inner barrel;

a plurality of chuck pieces provided at a front end portion of the inner barrel to fasten and release a stick-shaped material, said chuck pieces capable of advancing and retracting;

a chuck ring inserted between the chuck pieces and the outer barrel; and frictional force applying parts formed on an inner peripheral surface of said outer barrel to impart a frictional force to a stick-shaped material to hold it in position while the chuck pieces are retracting, each frictional force applying part being assigned to a vertex of the polygon of a stick-shaped material and at least one of said frictional force applying parts comprising a pair of flexible projections which project radially inward from the inner peripheral surface of said outer barrel and are adapted to abut on adjacent sides to the assigned vertex of the polygon symmetrically with respect to a center line of the polygon, which passes through the assigned vertex between the adjacent sides of the polygon, and the other frictional force applying parts comprising a flexible projection which projects radially inward from the inner peripheral surface of said outer barrel and is adapted to abut on only either one of adjacent sides to the assigned vertex of the polygon.

6. The stick-shaped material propelling container according to claim 5, wherein the chuck pieces are adapted to abut on a central portion of an assigned side of the polygon of a stick-shaped material, and said flexible projections are adapted to abut on a vertex side of the polygon from the central portion where the chuck pieces are adapted to abut on.

7. The stick-shaped material propelling container according to claim 5, wherein an extending direction of each flexible projection at a contact point where each flexible projection contacts a stick-shaped material is in a non-orthogonal relation in its cross section with respect to a tangential line of a stick-shaped material at the contact point.

8. The stick-shaped material propelling container according to claim 7, wherein at least one of said flexible projections is in a shape creating an asymptote toward the contact point of a stick-shaped material in its cross-section.

* * * * *